US005826138A

United States Patent [19]

Tsuru et al.

[11] Patent Number: 5,826,138

[45] Date of Patent: Oct. 20, 1998

[54] TONER SUPPLY ROLLER APPLIED WITH A.C. VOLTAGE IN NONMAGNETIC SINGLE COMPONENT DEVELOPING DEVICE

[75] Inventors: Akihiro Tsuru, Kitakyushu; Hiromitsu Shimazaki, Fukuoka-ken; Hironori Taguchi, Saga-ken; Kazuhiko Noda, Chikushino, all of Japan

[73] Assignee: Matsushita Electric Industrial Co., Ltd., Osaka, Japan

[21] Appl. No.: 856,251

[22] Filed: May 14, 1997

[30] Foreign Application Priority Data

Feb. 4, 1997 [JP] Japan ..... 9-021188

[51] Int. Cl.[6] ..... G03G 15/06

[52] U.S. Cl. ..... 399/55; 399/149; 399/281

[58] Field of Search ..... 399/149, 150, 399/281, 283, 284, 55

[56] References Cited

U.S. PATENT DOCUMENTS 5,172,169 12/1992 Takashima et al. ..... 399/281

FOREIGN PATENT DOCUMENTS 63-31778 2/1981 Japan .

*Primary Examiner*—William J. Royer

*Attorney, Agent, or Firm*—Stevens, Davis, Miller & Mosher, L.L.P.

[57] ABSTRACT

A nonmagnetic single component developing device comprises a developing roller having an outer surface on which a layer of a nonmagnetic single component developer composed of nonmagnetic toner is formed, a toner supply roller arranged in rear of the developing roller and made into contact therewith, for agitating and supplying the toner, a toner regulating blade arranged above the developing roller and made into press-contact therewith, for regulating a volume of the toner. The toner supply roller is electroconductive, and is applied thereto with an a.c. voltage so as to prevent lowering of the density in the leading and trailing end parts of an image so as to obtain a uniform image characteristic.

10 Claims, 3 Drawing Sheets

TONER SUPPLY ROLLER APPLIED WITH A.C. VOLTAGE IN NONMAGNETIC SINGLE COMPONENT DEVELOPING DEVICE

BACKGROUND OF THE INVENTION

1. Field of the Invention

The present invention relates to a nonmagnetic single-component device for visualizing an electrostatic latent image carried on a photosensitive medium with the use of nonmagnetic toner particles.

2. Description of Related Art

These years, there have been widely available electronic photographing devices using dry toner, such as copying machines, laser printers, facsimile devices using ordinary paper, and the like, exhibiting a high degree of resolution and a high image quality, and such devices are now still being developed. Such electronically photographing devices use electronically photographing technique, that is, it can visualize a latent image carried on a photosensitive medium with the use of toner particles. Nonmagnetic single component developing devices and two component developing devices have been developed for these electronic photographing devices. In particular, the nonmagnetic single component device is advantageous in comparison with the two component developing device since it does not use a carrier so that no special consideration has to be paid for deterioration of the carrier, and detection of a toner density in view of a ratio of mixture between carrier and toner during development of an image, provision of a control device and so forth. Further, the nonmagnetic single component developing device is advantageous since no carrier sticks to the outer surface of the photosensitive medium during development of an image, and as a result, it is possible to prevent the outer surface of the photosensitive medium from being damaged during cleaning of the photosensitive medium by a cleaning device for removing residual toner after a toner image visualized on the outer surface of the photosensitive medium is transferred onto an image bearing medium. Thus, these nonmagnetic single component developing devices are advantages in view of small-sizing and cost lowering thereof since control mechanisms for mixture of carrier and toner and the density of toner, and the like which are indispensable for two component developing devices are not required. Thus, electronic photographing devices using such a nonmagnetic single component developing device are widely available.

A nonmagnetic single component developing device as a related art will be explained with reference to FIG. 3 which is a sectional view showing an electronic photographing apparatus 1' using a conventional single component developing device incorporating a photosensitive medium 2 as an electrostatic latent image carrying medium, and a charger 3 arranged adjacent to the photosensitive medium 2 and composed of a charging wire 3*a,* a metal shield panel 3*b* and a grid panel 3*c*. The charging wire 3*a* produces corona discharge which charges the outer surface of the photosensitive medium 2 through the intermediary of the grid panel 3*c*. An exposure optical system 4 directs an exposure beam 5 onto the photosensitive medium 2 so as to form an electrostatic latent image thereon. Nonmagnetic single component toner 7 which is stored in a developing hopper 6 is agitated by a toner agitating member 8 which depicts a circle in synchronization with a toner supply roller 10 in order to prevent the toner 7 stored in the developing hopper 6 from coagulating, and to feed the toner 7 onto the supply roller 10. A developing roller 9 serving as a toner carrying member adapted to make contact with or located adjacent to the photosensitive medium 2 is arranged in the developing hopper 6, having a shaft 9*a,* and is fed thereonto with the toner 7 agitated and transferred by the toner agitating member 8, by means of the toner supply roller 10 having a shaft 10*a*. The developing roller 9 and the toner supply roller 10 have their cores made of metal such as stainless steel, and covered thereover with elastic material layers made of urethane, silicone or the like, and are rotatably journalled to opposite sides of the housing of the developing hopper 6. A toner regulating blade 11 is composed of a metal leaf spring member 11*a*, and a toner regulating member 11*b* adapted to make contact with the outer periphery of the developing roller 9, the toner regulating member 11*b* being formed of an elastic member made of silicone, urethane or the like and provided at one end of the metal leaf spring 11*a*. The toner regulating ember 11 is secured to a blade holder 11*c* by fastening screws. The toner 7 fed by the toner supply roller 10 is held between the toner regulating blade 11 and the developing roller 9 so as to be subjected to frictional electrification, and accordingly, a thin layer of the toner 7 is formed over the outer periphery of the developing roller 9. A developing bias power source 12 applies a bias voltage onto the developing roller 9, and accordingly, the toner 7 is transferred from the developing roller 9 onto and stuck to a part of the photosensitive medium 2 on which a latent image is formed, so as to visualize the latent image. It is noted that the nonmagnetic single component developing device is composed of the developing hopper 6, the nonmagnetic single component toner 7, the toner agitating member 8, the developing roller 9, the toner supply roller 10, the shafts 9*a,* 10*a,* the toner regulating blade 11 and the blade holder 11*c*.

A discharger 13 for removing residual charge in the form of a residual latent image on the photosensitive medium 2 after the toner 7 on the photosensitive medium 2 is transferred and cleaned. Sheets 14 as recording media are stored in a sheet cassette 15, are taken out one by one by a semicircular roller 16, and are conveyed by conveying rollers 17*a,* 17*b*. A registration roller 18 once stops and holds each of the sheets 14 in order to align the sheet with a toner image formed on the photosensitive medium 2, and a driven roller 19 makes contact with the registration roller 18. A transfer roller 20 which makes contact with the photosensitive medium 2 through the intermediary of the sheet 14, is rotatably journalled by means of a shaft 20*a,* and is composed of a core made of metal such as stainless steel and covered over its outer peripheral surface with an elastic material layer. A transfer bias power source 21 supplies a high bias voltage to the transfer roller 20 so as to apply a charge having a polarity reverse to that of the toner 7 onto the rear surface of the sheet 14, and accordingly, a toner image on the photosensitive medium 2 is transferred to the sheet 14. The sheet 14 is fed being held between a heat roller 23 which incorporates a heat source, and which is itself incorporated in a fixing unit 22, and a press roller 24 so that a toner image transferred on the sheet 14 is fixed due to heat and pressure given through the rotation of both heat roller 23 and press roller 24.

The developing operation of the electronic photographing device using the above-mentioned conventional single component developing device, constructed as mentioned above, will be explained thereinbelow. At first, a power source is applied to the body of the electronic photographing apparatus 1', and accordingly, a developing device driving part (which is not shown) drives the single-component developing device in response to a printing signal. Thus, the developing roller 9, the toner supply roller 10 and the toner agitating member 8 are rotated in the directions indicated by the arrows B, respectively. The rotation of the toner agitating member 8 causes the toner 7 to be conveyed to a position above the toner supply roller 10. The toner 7 at this position is frictionally electrified due to the contact between the toner supply roller 10 and the developing roller 9, and accordingly, the toner 7 sticks to the outer surface of the developing roller 9 due to the electrostatic force so as to form a toner layer which is then carried on the outer surface of the developing roller 9 on rotation to the nipping position between the developing roller 9 and the toner regulating blade 11. The toner layer is then subjected to frictional action under pressure given between the developing roller 9 and the toner regulating blade 11 so that the frictional electrification is enhanced, and accordingly, it is formed in a uniform thin layer. Further, the thin toner layer which has passed by the toner regulating blade 11, is then carried to a position where it makes contact with the photosensitive medium 2 (that is, developing zone) while it holds the frictional electrification having a substantial degree. At this contact position, the toner layer makes contact with the photosensitive medium 2. At this stage, with the provision of the developing bias power source 12, a potential difference is give between the developing roller 9 and the photosensitive medium 2, and accordingly, the toner 7 is transferred and sticks to a latent image formed on the photosensitive medium 2 so as to visualize the latent image so that the developing process is completed. Further, the toner 7 which has not been transferred onto the photosensitive medium 2 is scraped off, being still in the form of a thin layer, by the toner supply roller 10 and is then returned into the developing hopper 6.

However, with the above-mentioned conventional arrangement in which, in the case of the non-magnetic single component developing device, no magnetic force is used for conveying the toner 7, and accordingly, the thin layer of the toner 7 is formed on the developing roller 9 by an electrostatic force and the physical force between the developing roller and the toner 7, there has been a problem such that the toner to be used for development can hardly be conveyed stably and uniformly through one revolution of the developing roller 9.

Further, there has been a further problem such that if no toner of such a quantity corresponding to that of the toner 7 used for the development is supplied, the density of an image in the rear end part of the image having a high density in its entirety, is lowered.

Further, since the electrification of the toner 7 is made by the friction between the developing roller 9 and the toner 7, and the friction between the developing roller 9 and the toner regulating blade 11, if the layer of the toner 7 which has been formed on the developing roller 9 and which has not been consumed, has passed by the toner regulating blade 11 at several times, the degree of electrification has been increased each time when it passes by the toner regulating blade 11, and the sticking force of the toner 7 onto the developing roller 9 increases. As a result, the toner 7 cannot be transferred from the developing roller 9 onto the photosensitive medium 2. Thus, there has been present such a problem that the density of the leading end part of an image is lowered.

In order to solve the above-mentioned problem, a d.c. bias voltage has been applied to the toner supply roller 10. The electric field between the developing roller 9 and the toner supply roller 10 is set so that the toner 7 is transferred onto the developing roller 9, and accordingly, the toner 7 is sufficiently fed onto the developing roller 9, thereby it is possible to prevent the density of the trailing end part of an image from lowering. If the bias voltage is set so that the toner 7 is transferred to the toner supply roller 10, unconsumed toner 7 on the developing roller 9 is scraped off by the toner supply roller 10 so as to prevent the degree of electrification of the toner 7 on the developing roller 9 from increasing, thereby it is possible to eliminate the problem of the lowering of the density of the leading end part of the image. However, there has been a problem that terms for solving the two problems in the above-mentioned solving measure, are contradictory, and can hardly be compromised with each other.

SUMMARY OF THE INVENTION

The present invention has been devised in order to solve the above-mentioned problems inherent to the prior art, and accordingly, one object of the present invention is to provide a nonmagnetic single component developing device which can eliminate both the problem for lowering the density of the trailing end part of an image and the problem of lowering the density of the leading end part of an image so as to obtain a uniform image characteristic, and which can exhibit a high image quality, a high resolution and a high reliability.

To the end, according to the present invention, there is provided a nonmagnetic single component developing device comprising a developing roller having its outer surface on which a layer of nonmagnetic single component developer is formed, a rear part and an upper part, and applied with a developing bias voltage, a toner supply roller made into contact with the rear part of the developing roller, for feeding the toner onto the developing roller during rotation thereof, a toner regulating blade arranged at the upper part of the developing roller and made into press-contact with the latter, for regulating the quantity of the toner, wherein the toner supply roller is formed of an electroconductive member, and the toner supply roller incorporates a toner supply roller bias power source for applying an a.c. voltage to the toner supply roller.

With this arrangement in which the toner supply roller is formed of an electroconductive member, and is applied thereto with an a.c. voltage, the transfer of the toner onto the developing roller from the toner supply roller and the scrape-off of unconsumed toner can be simultaneously made by the toner supply roller, thereby it is possible to prevent the density of the trailing end part of an image and the density of the leading end of the image from lowering.

DETAILED DESCRIPTION OF PREFERRED EMBODIMENT OF THE INVENTION

First Embodiment

Figure 1:
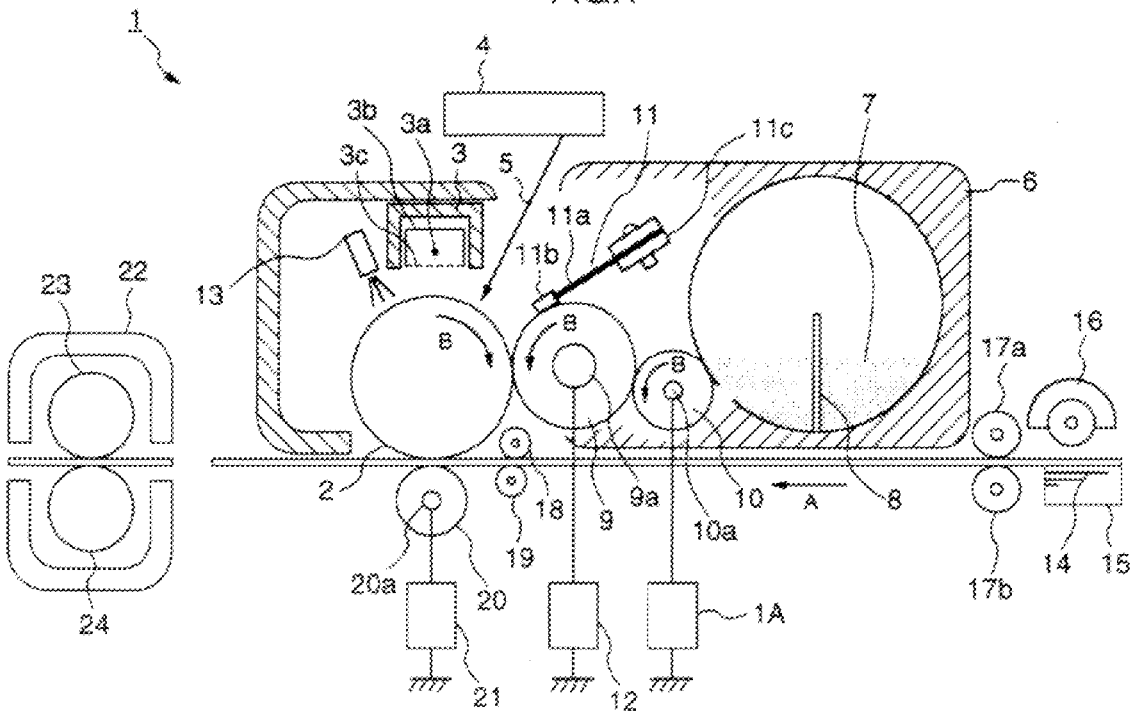
FIG. 1 is a sectional view illustrating an electrophotographing device using a nonmagnetic single component developing device in a first embodiment of the present invention.

Referring to FIG. 1 which is a sectional view illustrating an electrophotographing device 1 using a nonmagnetic single component developing device in a first embodiment of the present invention, the electrophotographing device 1 includes a photosensitive medium 2 as a latent image carrier member which is composed of a metal drum made of aluminum or the like as a base material, and which is coated over its outer peripheral surface with a thin film-like photosensitive receptor layer made of selenium (Se), organic photoelectric conductor or the like, a charger 3 arranged adjacent to the photosensitive medium 2 and composed of a charging wire 3*a* made of tungsten or the like, a metal shield panel 3*b* and a grid panel 3*c*. The charge wire 3*a* produces corona discharge which electrifies the entire outer surface of the photosensitive medium 2, through the intermediary of the grid panel 3*c*. An exposure optical system 4 directs an exposure beam 5 onto the photosensitive medium 2, that is, an image signal is subjected to light intensity modulation or pulse width modulation by means of a laser drive circuit (which is not shown) so as to form a latent image on the photosensitive medium 2. Nonmagnetic single component toner 7 which is stored in a developing hopper 6 is agitated by a toner agitating member 8 which depicts a circle in synchronization with the rotation of a toner supply roller 10 in order to prevent the toner 7 stored in the developing hopper 6 from coagulating, and to feed the toner 7 onto the toner supply roller 10. A developing roller 9 arranged in the developing hopper 6 and serving as a toner carrying member adapted to make contact with or located adjacent to the photosensitive medium 2, has a shaft 9*a*, and is fed thereonto with the toner 7 agitated and transferred by the toner agitating member 8, by means of the toner supply roller 10 having a shaft 10*a* which is connected to a toner supply roller bias power source 1A so as to be applied thereto with an a.c. voltage. The developing roller 9 and the toner supply roller 10 have their cores made of metal such as stainless steel, and covered thereover with elastic material layers made of urethane, silicone or the like, and are rotatably journalled to the housing of the developing hopper 6 at opposite ends thereof. A toner regulating blade 11 is composed of a metal leaf spring member 11*a* and a toner regulating member 11*b* adapted to make contact with the outer periphery of the developing roller 9, the toner regulating member 11*b* being formed of an elastic member made of silicone, urethane or the like and provided at one end of the metal leaf spring member 11*a*. The toner regulating member 11 is secured to a blade holder 11*c* by fastening screws. The toner 7 fed by the toner supply roller 10 is held between the toner regulating blade 11 and the developing roller 9 so as to be subjected to frictional electrification, and accordingly, a thin layer of the toner 7 is formed over the outer peripheral surface of the developing roller 9. A developing bias power source 12 applies a bias voltage onto the developing roller 9, and accordingly, the toner 7 is transferred from the developing roller 9 onto and stuck to a part of the photosensitive medium 2 on which a latent image is formed, so as to visualize the latent image. It is noted that the nonmagnetic single component developing device is composed of the developing hopper 6, the nonmagnetic single component toner 7, the toner agitating member 8, the developing roller 9, the toner supply roller 10, the shafts 9*a*, 10*a*, the toner regulating blade 11 and the blade holder 11*c*.

A discharger 13 for removing residual charge in the form of a residual latent image on the photosensitive medium 2 after the toner 7 on the photosensitive medium 2 is transferred and cleaned. Sheets 14 as recording media are stored in a sheet cassette 15 and are taken out one by one by a semicircular roller 16, and are conveyed by conveying rollers 17*a*, 17*b*. A registration roller 18 once stops and holds each of the sheets 14 in order to align the sheet with a toner image formed on the photosensitive medium 2, and a driven roller 19 makes contact with the registration roller 18. A transfer roller 20 which makes contact with the photosensitive medium 2 through the intermediary of the sheet 14, is rotatably journalled by means of a shaft 20*a*, and is composed of a core made of metal such as stainless steel and covered over its outer peripheral surface with an elastic material layer. A transfer bias power source 21 supplies a high bias voltage to the transfer roller 20 so as to apply a charge having a polarity reverse to that of the toner 7 onto the rear surface of the sheet 14, and accordingly, a toner image on the photosensitive medium 2 is transferred to the sheet 14. The sheet 14 is fed being held between a heat roller 23 which incorporates a heat source, and which is itself incorporated in a fixing unit 22, and a press roller 24 so that a toner image transferred on the sheet 14 is fixed due to heat and pressure given through the rotation of both heat roller 23 and press roller 24.

The developing operation of the electronic photographing device using the above-mentioned nonmagnetic single component developing device in the first embodiment of the present invention, constructed as mentioned above will be explained thereinbelow. Processing terms therefore are as follows: The photosensitive medium 2, the developing roller 9 and the toner supply roller 10 are rotated in directions indicated by the arrows B shown in FIG. 1, and are made into contact with each other at their contact parts. The photosensitive medium 2 is formed of a negative charge type POC, and is uniformly electrified at −700 V by means of the charger 3. The developing roller 9 is composed of the metal shaft 9*a* as a core covered over its outer peripheral surface with a single layer made of silicone rubber in the form of an electroconductive resilient member having a resistance value of $10^6$ Ωcm. Further, a −300 V d.c. voltage is applied to the shaft 9*a* of the developing roller 9 by means of the developing bias power source 12. The rubber hardness of the developing roller 9 is preferably in the range from 30 to 60 deg, and the smoother the surface roughness of the outer surface of the developing roller 9, the more uniform thickness of a thin toner layer is formed. Accordingly, the surface roughness is preferably less than 7 μmRz. In this embodiment, the developing roller 9 has a rubber hardness of 40 deg. and a surface roughness of 3 mRz. The toner supply roller 10 is covered over its outer peripheral surface of the metal shaft 10*a* with an electroconductive foamed material so as to have a resistance value of $10^6$ Ωcm. The toner supply roller bias power source 1A is connected to the shaft 10*a*. This toner supply roller 10 feeds the toner 7 fed from the developing hopper 6 to the developing roller 9, and has a function for scraping off the toner 7 which remains on the developing roller 9 without being used during development. The nip width between the toner supply roller 10 and the developing roller 9 is set to be 2 mm. The toner regulating blade 11 is composed of the metal leaf spring 11*a* having a resiliency and made of stainless sheet, phosphor bronze plate or the like, and the toner regulating member 11*b* as an elastic member integrally incorporated with the one end of the metal leaf spring member 11*a* and made of urethane rubber having a rubber hardness of 60 deg, the toner regulating member 11*b* being fastened to the blade holder 11*c* by means of screws. The toner regulating member 11*b* presses the developing roller 9 with a line pressure of 80 g/cm so as to form a toner layer having 0.5 mg/cm$^2$ on the outer surface of the developing layer 9. In the nonmagnetic single component developing device in this embodiment, the toner layer on the developing roller 9 is preferably in the range from 0.3 to 0.6 mg/cm$^2$. The toner 7 is nonmagnetic single component toner which is obtained by dispersing carbon, wax, charge control agent or the like uniformly into polyester resin, that is, negative chargeable toner is used. The transfer roller 20 is composed of the metal shaft 20*a* covered over its outer peripheral surface with an electroconductive foamed material, having $10^7$ Ωcm. The shaft 20*a* is connected thereto with the transfer bias power source 21 such as a constant current source of 4 μA.

Next, explanation will be hereinbelow made of the electrophotographing device using the nonmagnetic single component developing device in the first embodiment of the present invention. At first, the photosensitive medium 2 is uniformly electrified at −700 V by the charger 3, and then it is exposed by the exposure optical system so that the potential of the outer surface of the photosensitive medium 2 after the exposure is attenuated down to −100V. Meanwhile, a −300 V developing bias voltage is applied to the developing roller 9 so as to form a toner image on the photosensitive medium 2 from which the toner image is then transferred onto a sheet 14 by applying a current of 4 μA to the sheet 14 from the transfer roller 20. Finally, the toner image is fixed to the sheet 14 by a well-known fixing process which is generally known in the electrophotographing process technology.

(EXPERIMENTAL EXAMPLE 1)

In an electrophotographing device using the nonmagnetic single component developing device in the above-mentioned first embodiment of the present invention, the peak-to-peak voltage $V_{p-p}$ of a.c. voltage was changed so as to visually evaluate the difference in density between the leading and trailing end parts of an image. In this experimental example 1, terms of the electrophotographing process during printing, were set as follows: a process speed was 76 mm/sec, a peripheral speed of the developing roller was 152 mm/sec, and a peripheral speed of the toner supply roller 10 was 106 mm/sec. Thus, a relative speed v at the contact position between the developing roller 9 and the toner supply roller 10 was 258 m/sec. Further, the shaft 9*a* of the developing roller 9 was applied with a d.c. voltage of −300 V by the developing bias power source 12. Experiments were carried out in such a condition that the toner supply roller bias power source 1A delivered a.c. voltage at a frequency of 140 Hz, and the peak-to-peak voltage $V_{p-p}$ of the a.c. voltage was changed as 200 V, 400 V, 600 V and 800 V. As to measurements and evaluations, an image having a high density over the entire surface thereof was printed, and a leading end density and a trailing end density of the image was measured with the use of a Macbeth densitometer and visual three stage evaluations, that is, ○, Δ and x, which indicate no lowering of density, a slight lowering of density and lowering of density, respectively, were carried out. The results of the experiments are shown in Table 1.

TABLE 1

| a.c. voltage $V_{p-p}$ (V) | leading end density | trailing end density | evaluation of difference in density |
|---|---|---|---|
| 200 | 1.25 | 1.13 | X |
| 400 | 1.38 | 1.15 | X |
| 600 | 1.41 | 1.25 | Δ |
| 800 | 1.40 | 1.38 | ○ |

As clearly understood from the above-mentioned table 1, the difference in density between the leading end part and the trailing end part of the image becomes unremarkable as the peak-to-peak a.c. voltage $V_{p-p}$ exceeds 600 V, and accordingly, it was found that the developing bias voltage $V_B$ between peaks of a.c. voltage is satisfactory. That is, it is satisfactory if $V_{p-p}$ is set to a value which is larger than two times as large as the absolute value of $V_B$. This is because the toner is transferred onto the developing roller 9 if the toner supply roller bias voltage is lower than the developing bias voltage, but unconsumed toner is scraped off if the toner supply roller bias voltage is higher in the case of using negative charge toner.

In the above-mentioned embodiment, the transfer of toner onto the developing roller and the scrape-off of unconsumed toner can be simultaneously made, and accordingly, it is possible to eliminate both problems of lowering the densities of the leading and trailing end parts of an image. In particular, if the value of the developing bias voltage $V_B$ and the a.c. peak-to-peak voltage $V_{p-p}$ satisfies the following relationship: $|V_{p-p}|>2\ |V_B|$, both transfer of toner onto the developing roller and scrape-off of unconsumed toner can be simultaneously carried out, and accordingly, it is possible to enhance the reliability and to satisfy the image quality.

Second Embodiment 2

Explanation will be made of a nonmagnetic single component developing device in a second embodiment of the present invention.

This second embodiment is similar to the first embodiment, except that the toner supply roller bias power source 1A as mentioned in the first embodiment superposes a d.c. voltage having the same polarity as that of the developing bias voltage applied to the developing roller 9, onto an a.c. voltage applied to the toner supply roller 10.

(EXPERIMENTAL EXAMPLE 2)

In an electrophotographing device using the nonmagnetic single component developing device in the second embodiment constructed as mentioned above, a constant d.c. voltage $V_{SR}$ was applied to the toner supply roller 10, the value of a.c. voltage was changed so as to carry out the measurement of densities of the leading end part and the trailing end parts of an image, and the visual evaluation of difference in density. In this second embodiment, terms of a photographing process were as follows: the toner supply roller bias power source 1A applied a voltage which was obtained by superposing an a.c. voltage at a frequency of 140 Hz, onto a d.c. voltage of −400 V, to the toner supply roller 10. The terms other than that for the toner supply roller 10, were the same as those explained in the first embodiment, and according, the developing bias power source 12 applied a d.c. voltage of −300 V to the shaft 9*a* of the developing roller 9. Experiments were carried out while the toner supply roller bias power source 1A changed the peak-to-peak a.c. voltage $V_{p-p}$ such as 100 V, 200 V, 300 V and 400 V. The measurements and the evaluations were similar to those in the first embodiment. The results of the experiments are shown in Table 2.

TABLE 2

| a.c. voltage $V_{p-p}$ (V) | leading end density | trailing end density | evaluation of difference in density |
|---|---|---|---|
| 100 | 1.25 | 1.42 | X |
| 200 | 1.35 | 1.41 | Δ |

TABLE 2-continued

| a.c. voltage $V_{p-p}$ (V) | leading end density | trailing end density | evaluation of difference in density |
|---|---|---|---|
| 300 | 1.40 | 1.42 | ○ |
| 400 | 1.41 | 1.42 | ○ |

As clearly understood from table 2, the difference in density between the leading end part and the trailing end part of an image becomes unremarkable if the peak-to-peak a.c. voltage $V_{p-p}$ exceeds 200 V. If is found that the developing bias voltage between the peaks of the a.c. voltage is satisfactory, similar to the first embodiment. That is, it is satisfactory if $V_{p-p}$ is set to a value which is higher than a value which is two times as high as a difference between $V_{SR}$ and $V_B$ while the polarity of the toner supply bias d.c. voltage is set to be the same as that of the developing bias voltage $V_B$.

In this embodiment as mentioned above, the charge to the toner is carried also on the toner supply roller, and accordingly, the charge to the toner can be surely and stably carried out. Further, if the value of the developing bias voltage $V_B$ applied to the developing roller and the a.c. peak-to-peak voltage $V_{p-p}$ applied to the toner supply roller 10 satisfy the following relationship: $|V_{p-p}|>2|V_B-V_{SR}|$ where $V_{SR}$ is a d.c. voltage applied to the a.c. voltage, both transfer of toner onto the developing roller and scrape-off of unconsumed toner can be simultaneously carried out, and accordingly, it is possible to eliminate both problems of lowering the densities of the leading and trailing end parts of an image.

Third Embodiment

Explanation will be hereinbelow made of a nonmagnetic single component developing device in a third embodiment. The nonmagnetic single component developing device in this third embodiment is similar to that in the second embodiment, except that the toner supply roller bias power source 1A as mentioned in the second embodiment applies an a.c. voltage at a frequency f (Hz) which is set so as to satisfy the following relationship: f>v/l where v is a relative speed (mm/sec) in a rotating direction at the contact position between the developing roller 9 and the toner supply roller 10, and l is a nip width (mm) between the developing roller 9 and the toner supply roller 10. It is noted here that the nip width is the width of contact between the developing roller 9 and the toner supply roller 10 in the rotating direction of the developing roller 9.

In the first and second embodiments, the difference in density between the leading end part and the trailing end part of an image having a high density over its entire surface can be solved by applying an a.c. voltage to the toner supply roller 10. However, if the frequency of the a.c. voltage is decreased, periodical unevenness in density is possible caused in dependence upon a frequency.

(EXPERIMENTAL EXAMPLE 3)

Accordingly, in an electrophotographing device using the nonmagnetic single component developing device in the third embodiment of the present invention, the frequency of a.c. voltage applied to the toner supply roller 10 and the relative speed at the contact position between the developing roller 9 and the toner supply roller 10 were changed so as to measure unevenness in density. In the third embodiment, terms of an electrophotographing process during printing as follows: the toner supply roller bias power source 1A delivered a voltage which was obtained by superposing an a.c. voltage having a peak-to-peak voltage of 300 V onto a d.c. voltage of −400 V. Further, a process speed was 76 mm/sec, a peripheral speed of the developing roller 9 was 152 mm/sec, and a peripheral speed of the toner supply roller 10 was 106 mm/sec so that a relative speed v at the contact position between the developing roller 9 and the toner supply roller 10 was set to 258 mm/sec. Further, the peripheral speeds of the developing roller 9 and the toner supply roller 10 were set to 76 mm/sec and 53 mm sec, that is, half values of the above-mentioned values, and accordingly, the relative speed at the contact position between the developing roller 9 and the toner supply roller 10 was set to 129 mm/sec. In this condition, experiments were carried out while the frequency of the a.c. voltage applied to the toner supply roller 10 was changed at 6 stages such as 30 Hz, 60 Hz, 90 Hz, 120 Hz, 150 Hz and 180 Hz. An image having a high density over its entire surface was printed, visual evaluations to unevenness in density depending upon a frequency were made at three stages of ○, Δ and x, which indicate no lowering of density, a slight lowering of density and lowering of density, respectively. The results thereof are shown in Table 3.

TABLE 3

| a.c. voltage frequency | evaluation of unevenness in density (v: relative speed) v = 258 mm/sec | V = 129 mm/sec |
|---|---|---|
| 30 | X | X |
| 60 | X | Δ |
| 90 | X | ○ |
| 120 | Δ | ○ |
| 150 | ○ | ○ |
| 180 | ○ | ○ |

As clearly understood from Table 3, in the case of the relative speed v=258 mm/sec, the unevenness in density becomes unremarkable at a frequency higher than 120 Hz. Further, in the case of the relative speed v=129 mm/sec, it becomes unremarkable at a frequency higher than 60 Hz. Further, the unevenness in density can be completely eliminated at frequencies 150 Hz and 90 Hz, respectively. Since a difference in relative speed between the developing roller 9 and the toner supply roller 10 cause appropriate frequencies f to be different, the following facts are known:

If the time of passing of the toner supply roller 10 over the nip width l between the developing roller 9 and the toner supply roller 10 is shorter than the cycle period (1/f) of a.c. voltage, unevenness appears in a toner layer on the developing roller 9. Accordingly, in order to prevent occurrence of unevenness in the toner layer, the frequency f (Hz) of a.c. voltage should satisfy the following relationship: f>v/1 where v (mm/sec) is a relative speed at the contact position between the developing roller 9 and the toner supply roller 10 in the direction of the developing roller 9, and l (mm) is the nip width therebetween.

In this embodiment, since the nip width l is 1=2 mm, in the case of V=258 mm/sec, a frequency higher than 129 Hz is appropriate. In this embodiment, a d.c. voltage and an a.c. voltage which are superposed with each other are applied as a toner supply roller bias voltage, but similar effects can be obtained even though only an a.c. voltage is applied thereto.

As mentioned above, in this embodiment, occurrence of periodical unevenness in density caused by a frequency of an a.c. voltage can be prevented, in addition to unevenness in density in the leading end part and trailing end part of an image, thereby it is possible to enhance the image quality.

Fourth Embodiment

Figure 2:
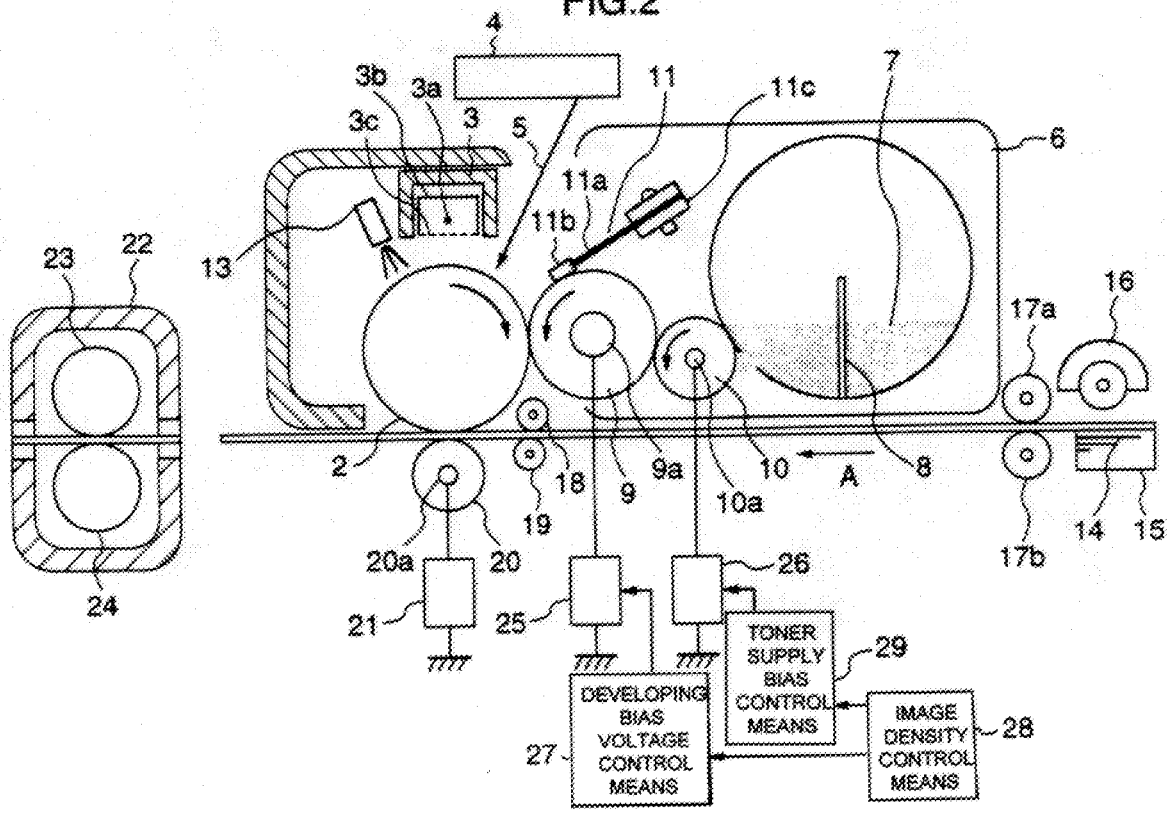
FIG. 2 is a sectional view illustrating an electrophotographing device using a nonmagnetic single component developing device in a fourth embodiment of the present invention.
Figure 3:
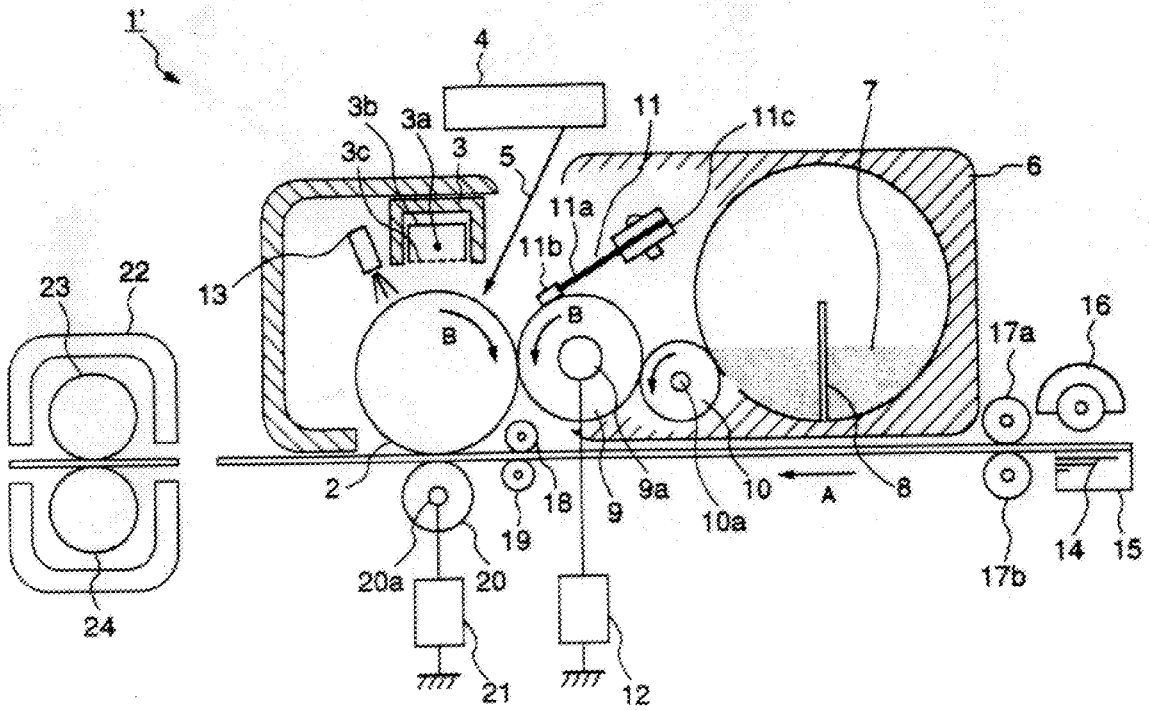
FIG.3 PRIOR ART
FIG. 3 is a sectional view illustrating an electrophotographing device using a conventional nonmagnetic single component device.

FIG. 2 is a sectional view which shows an electrophotographing device using a nonmagnetic single component developing device in a fourth embodiment of the present invention. This embodiment is similar to the first to third embodiment, except as follows: a developing bias voltage control means 27 and a toner supply bias control means 29 are connected to a developing bias power source 25 and a toner supply roller bias power source 26, respectively, and an image density control means 28 is connected to the developing bias voltage control means 27 and the toner supply roller bias voltage control means 29. When manual input is made through a control panel (which is not shown), the image density control means 28 causes the developing bias power supply 25 and the toner supply roller bias power source 26 to change their output voltages, and accordingly, the image density can be changed at seven stages.

(EXPERIMENTAL EXAMPLE 4)

With the use of an electrophotographing device using the nonmagnetic single component developing device constructed as mentioned above together with the photosensitive medium 2 and the toner 7 both having negative charge type, the following printing operation was carried out. In this case, a process speed was 76 mm/sec, a peripheral speed of the developing roller 9 was 105 mm/sec, and a peripheral speed of the toner supply roller 10 was 75 mm/sec.

After the photosensitive medium 2 was uniformly electrified at −700 V, the photosensitive medium was exposed by the exposure optical system 4 so that the surface potential of the photosensitive medium 2 was attenuated down to −100 V after the exposure, and a developing bias voltage was applied to the developing roller 9 so as to form a toner image on the photosensitive medium 2, and the toner image was then transferred onto a sheet 14 by applying a current of 4 $\mu$A to the sheet 14 from the transfer roller 20. Accordingly, the toner image was obtained on the sheet 14 after it is passed through a well-known fixing process. At this time, a peak-to-peak a.c. voltage $V_{p-p}$ for the toner supply roller bias voltage was set to 700 V while a frequency f was set to 300 Hz. Although the developing bias voltage can be changed at seven stages by the image density control means 28, the developing bias voltage was changed such as a minimum value of −400 V, a maximum value of −100 V and an intermediate value of −250 V, and a potential difference $V_{SR}-V_B$ between the developing voltage $V_B$ and the d.c. voltage $V_{SR}$ of the toner supply bias voltage, was changed so as to obtain an image having a high density over its entire surface through the above-mentioned printing operation. Then, the image quality as to the lowering of the density in the leading end part and the trailing end part of the image was visually evaluated. The evaluation was made at three stages ○, Δ and x. The results of the evaluation are shown in Table 4.

TABLE 4

| $V_B$ (V) | $V_{SR}$ (V) | $V_{SR}$ (V) − $V_B$ (V) | lowering of density in leading end | lowering of density in trailing end |
|---|---|---|---|---|
| −100 | −400 | −300 | X | X |
| −100 | −300 | −200 | Δ | ○ |
| −100 | −200 | −100 | ○ | ○ |
| −100 | −100 | 0 | ○ | ○ |
| −100 | 0 | 100 | ○ | ○ |
| −100 | 100 | 200 | ○ | Δ |
| −100 | 200 | 300 | ○ | X |
| −250 | −550 | −300 | X | ○ |
| −250 | −450 | −200 | Δ | ○ |
| −250 | −350 | −100 | ○ | ○ |
| −250 | −250 | 0 | ○ | ○ |
| −250 | −150 | 100 | ○ | ○ |
| −250 | −50 | 200 | ○ | Δ |
| −250 | 50 | 300 | ○ | X |
| −400 | −700 | −300 | X | ○ |
| −400 | −600 | −200 | Δ | ○ |
| −400 | −500 | −100 | ○ | ○ |
| −400 | −400 | 0 | ○ | ○ |
| −400 | −300 | 100 | ○ | ○ |
| −400 | −200 | 200 | ○ | Δ |
| −400 | −100 | 300 | ○ | X |

○: no lowering of density, Δ: slight lowering of density, X: lowering of density.

As clearly understood from Table 4, if the d.c. voltage of the toner supply roller bias voltage is changed in accordance with a variation in the developing bias voltage so as to satisfy the following relationship: $|V_{SR}-V_S| \leqq 200$ where $V_B$ is the developing bias voltage and $V_{SR}$ is the d.c. voltage of the toner supply roller bias voltage, and accordingly, it is possible to prevent lowering of the densities in the leading and trailing end parts of an image formed by the nonmagnetic single component developing device.

Fifth Embodiment

Next, the peak-to-peak a.c. voltage $V_{p-p}$ of the toner supply roller bias, the potential difference $V_{SR}-V_B$ between the d.c. voltage $V_{SR}$ of the toner supply roller bias voltage and the developing bias voltage $V_B$ were changed so as to evaluate the image quality.

(EXPERIMENTAL EXAMPLE 5)

Terms of a developing process were as follows:

Developing Bias Voltage $V_B$: −250 V

D.C. Voltage $V_{SR}$ of Toner Supply Bias Voltage: −350 V

Frequency f of A.C. Voltage of Toner Bias Voltage: 300 Hz

Process Speed: 76 mm/sec

Peripheral Speed of Developing Roller: 105 mm/sec

Peripheral Speed of Toner Supply Roller: 75 mm/sec.

In the above-mentioned condition, and with the arrangement and the printing operation which are the same as those of the fourth embodiment, an image having a high density over its entire surface was obtained, the lowering of the density in the leading and part and lowering of the density in the trailing end part of the image were evaluated. The evaluation was made at three stages, that is, ○, Δ and x. The results of the evaluations are shown in Table 5.

TABLE 5

| $V_B$ (V) | $V_{SR}$ (V) | $V_{SR}$ (V) − $V_B$ (V) | $V_{p-p}$ (V) | lowering of density in leading end | lowering of density in trailing end |
|---|---|---|---|---|---|
| −250 | −150 | 100 | 200 | ○ | X |
| −250 | −150 | 100 | 250 | ○ | X |
| −250 | −150 | 100 | 300 | ○ | Δ |
| −250 | −150 | 100 | 350 | ○ | ○ |
| −250 | −250 | 0 | 50 | X | X |
| −250 | −250 | 0 | 100 | Δ | Δ |
| −250 | −250 | 0 | 150 | ○ | ○ |
| −250 | −250 | 0 | 200 | ○ | ○ |
| −250 | −350 | −100 | 200 | X | ○ |
| −250 | −350 | −100 | 250 | X | ○ |
| −250 | −350 | −100 | 300 | Δ | ○ |
| −250 | −350 | −100 | 350 | ○ | ○ |

○: no lowering of density, Δ: slight lowering of density, X: lowering of density.

As understood from Table 5, it is possible to prevent lowering of the density in the leading and trailing end parts of an image in the nonmagnetic single component developing device by satisfying the following relationship: $V_{p-p} \geqq 2(V_{SR}-V_B|+50)$ where $V_B$ is the developing bias voltage, $V_{SR}$ is the d.c. voltage of the toner supply roller bias voltage, and $V_{p-p}$ is the peak-to-peak a.c. voltage of the toner supply roller bias voltage.

In the fourth and fifth embodiments, it has been explained that the control of the image density is made by manual input through the control panel. However, the image control can also be automatically made in response to detection signals from various elements such as a temperature detecting element, a humidity detecting element and an image density detecting element which are provided in the electrophotographing device.

In the present embodiment, the waveform of an a.c. voltage applied to the toner supply roller, may be a sinusoidal waveform, a triangular waveform, a rectangular waveform or the like. Further, a system including a positive charge photosensitive medium 2 and a positive charge toner 7 can be used, instead of the negative charge photosensitive medium 2 and the negative charge toner 7 as explained in this embodiment. Further, although it has been explained that the toner regulating member 11*b* is made of urethane rubber, the toner regulating member 11*b* may be also made of various resin materials including silicone rubber, fluororubber, acrylic rubber, butadiene rubber, EPD rubber or the like, or metal. It is noted here that such a material is excellent in wear-resistant characteristic in order to prevent aging effect in the volume of toner sticking to the developing roller 9. Further, as the developing roller 9, not only an elastic roller but a metal roller or a resin roller can be used therefor. Further, such an arrangement that the developing roller 9 is not made into contact with the photosensitive medium 2 can be also used.

What is claimed is:

1. A nonmagnetic single component developing device comprising:

a developing roller having an outer surface formed thereon with a layer of a nonmagnetic single component developer comprising nonmagnetic toner;

means for applying a developing bias voltage to the developing roller;

a toner supply roller arranged in rear of said developing roller and for making contact with the developing roller for agitating and supplying said toner to the developing roller; and a toner regulating member arranged above said developing roller and for making press-contact with the developing roller for regulating a volume of said toner, wherein:

said toner supply roller comprises an electroconductive member and a toner supply roller bias power source for applying an a.c. voltage to said toner supply roller; and a relationship $|V_{p-p}|>2|V_B|$ is satisfied, where $V_B$ (V) is said developing bias voltage and $V_{p-p}$ (V) is a peak-to-peak value of said a.c. voltage.

2. A nonmagnetic single component developing device as set forth in claim 1, wherein a relationship f>v/l is satisfied where f (Hz) is a frequency of said a.c. voltage applied to said toner supply roller, v (mm/sec) is a relative speed at a contact position between said developing roller and said toner supply roller in a direction of rotation of said developing roller, and l (mm) is a nip width between said developing roller and said toner supply roller.

3. A nonmagnetic single component developing device comprising:

a developing roller having an outer surface formed thereon with a layer of a nonmagnetic single component developer comprising nonmagnetic toner;

means for applying a developing bias voltage to the developing roller;

a toner supply roller arranged in rear of said developing roller and for making contact with the developing roller for agitating and supplying said toner to the developing roller; and a toner regulating member arranged above said developing roller and for making press-contact with the developing roller for regulating a volume of said toner;

said toner supply roller comprising an electroconductive member and a toner supply roller bias power source for applying an a.c. voltage to said toner supply roller, wherein said toner supply roller bias power source superposes a d.c. voltage having a polarity equal to a polarity of said developing bias voltage onto said a.c. voltage applied to said toner supply roller; and a toner bias voltage control means for changing a value of a d.c. voltage of said toner supply roller bias power source in dependence on a variation in a value of said developing bias voltage.

4. A nonmagnetic single component developing device as set forth in claim 3, wherein a relationship $|V_{p-p}|>2|V_B-V_{SR}|$ is satisfied, where $V_B$ (V) is said developing bias voltage applied to said developing roller $V_{p-p}$ (V) is a peak-to-peak value of said a.c. voltage applied to said toner supply roller, and $V_{SR}$ (V) is said d.c. voltage.

5. A nonmagnetic single component developing device as set forth in claim 3, wherein a relationship $|V_B-V_{SR}| \leqq 200$ is satisfied, where $V_B$ (V) is said developing bias voltage, and $V_{SR}$ (V) is said d.c. voltage.

6. A nonmagnetic single component developing device as set forth in claim 3, wherein a relationship $|V_{p-p}|>2(|V_B-V_{SR}+50)$ is satisfied where $V_B$ (V) is said developing bias voltage, $V_{SR}$ (V) is said d.c. voltage and $V_{p-p}$ (V) is a peak-to-peak value of said a.c. voltage.

7. A nonmagnetic single component developing device comprising:

a developing roller having an outer surface formed thereon with a layer of a nonmagnetic single component developer comprising nonmagnetic toner;

means for applying a developing bias voltage to the developing roller;

a toner supply roller arranged in rear of said developing roller and for making contact with the developing roller for agitating and supplying said toner to the developing roller, said toner supply roller comprising an electroconductive member and a toner supply roller bias power source for applying a toner supply roller bias voltage to said toner supply roller, the toner supply roller bias voltage comprising a d.c. voltage and an a.c. voltage;

a toner regulating member arranged above said developing roller and for making press-contact with the developing roller for regulating a volume of said toner; and a toner bias voltage control means for changing a value of the d.c. voltage in dependence upon a variation in a value of said developing bias voltage;

wherein a relationship $|V_{p-p}|>2|V_B|$ is satisfied, where $V_B$ (V) is said developing bias voltage and $V_{p-p}$ (V) is a peak-to-peak value of said a.c. voltage.

8. A nonmagnetic single component developing device as set forth in claim 7, wherein a relationship $|V_{p-p}|>2|V_B-V_{SR}|$ is satisfied, where $V_{SR}$ (V) is said d.c. voltage.

9. A nonmagnetic single component developing device as set forth in claim 7, wherein a relationship $|V_B-V_{SR}|\leqq 200$ is satisfied, where $V_{SR}$ (V) is said d.c. voltage.

10. A nonmagnetic single component developing device as set forth in claim 7, wherein a relationship $|V_{p-p}>2(|V_B-V_{SR}|+50)$ is satisfied, where $V_{SR}$ (V) is said d.c. voltage.

* * * * *